US006595393B1

(12) United States Patent
Loghman-Adham et al.

(10) Patent No.: US 6,595,393 B1
(45) Date of Patent: Jul. 22, 2003

(54) SPRAY DELIVERY SYSTEM AND METHOD FOR AEROSOL PRODUCTS

(75) Inventors: Kamran Loghman-Adham, Gaithersburg, MD (US); Michael J. Knickerbocker, Crystal Lake, IL (US)

(73) Assignee: Zarc International, Inc., Gaithersburg, MD (US)

( * ) Notice: Subject to any disclaimer, the term of this patent is extended or adjusted under 35 U.S.C. 154(b) by 0 days.

(21) Appl. No.: 10/036,544

(22) Filed: Jan. 7, 2002

(51) Int. Cl.[7] ..... B67D 5/378
(52) U.S. Cl. ..... 222/153.14
(58) Field of Search ..... 222/402.11, 153.11

(56) References Cited

U.S. PATENT DOCUMENTS

| | | | | |
|---|---|---|---|---|
| 3,602,399 A | | 8/1971 | Litman | |
| 3,608,785 A | | 9/1971 | Durso | |
| 3,760,988 A | | 9/1973 | Ostrowsky | |
| 3,828,982 A | | 8/1974 | Steigerwald | |
| 3,918,614 A | | 11/1975 | Steiman | |
| 3,940,023 A | | 2/1976 | Umstead | |
| 4,582,228 A | * | 4/1986 | Diamond et al. | 222/402.11 |
| 5,282,551 A | | 2/1994 | Pierson | |
| 5,458,263 A | | 10/1995 | Ciammitti | |
| 5,477,999 A | | 12/1995 | Blankenship | |
| 5,570,817 A | | 11/1996 | Anderson | |
| 5,901,723 A | | 5/1999 | Ames | |
| 5,988,450 A | | 11/1999 | Cassarino | |
| 6,145,654 A | | 11/2000 | Loghman | |

* cited by examiner

*Primary Examiner*—Philippe Derakshani
(74) *Attorney, Agent, or Firm*—Liniak, Berenato & White

(57) ABSTRACT

An improved spray delivery system and method for aerosol containers is provided. The system and method provide improved selectable spray pattern characteristics. In addition, the system is provided with multiple automatic features to prevent unintended actuation of the aerosol container as well as an override system to selectively disable these characteristics and automatically return the device to a safety position without requiring the user to see the device.

1 Claim, 11 Drawing Sheets

SPRAY DELIVERY SYSTEM AND METHOD FOR AEROSOL PRODUCTS

FIELD OF THE INVENTION

The present invention is directed to a spray delivery system and method of use for aerosol products. The invention is more particularly directed to a novel actuator, device and method that provides an improved and specific pattern of spray for dispensing aerosol products.

The invention further relates to a spray delivery system and method that contains selectively engageable automatic mechanisms for preventing accidental or unintended spraying of the aerosol product. The novel features of the present invention are particularly useful for aerosols that utilize hazardous chemicals, such as insecticides or non-lethal incapacitating agents.

BACKGROUND OF THE INVENTION

Aerosol spray containers have been well known in the art for decades. A typical aerosol container utilizes an assembly to actuate and release the pressurized materials in the canister and direct them toward an intended target. Such prior art containers have often utilized a spray through overcap consisting of a one piece housing and actuator. These containers are usually operated by directly pressing the actuator down to engage a valve stem and thereby release the pressurized material from the canister. Although devices of this type have at times been adequate to permit material to be sprayed from a pressurized canister, they have exhibited a number of drawbacks. To begin with, the spray pattern associated with such containers was generally imprecise or inconsistent. Such devices frequently exhibited a broad cone spray pattern with excessive turbulence and eddy currents. Such spray patterns have proven to be particularly troublesome in aerosol products containing hazardous or potentially irritating chemicals, particularly when used in windy or confined environments. Use of these devices frequently resulted in the spraying or contamination of unintended targets including the user.

In order to attempt to improve the spray characteristics of aerosols, a nozzle insert has sometimes added into the actuator. While this generally improved the spray characteristics, it still left other issues. For example, although such inserts were capable of focusing the output in a narrow stream, they did not perform well to precisely produce desired spray patterns that combined the characteristics of cone and stream type patterns. The resultant spray patterns were often so narrow that they required multiple sprays or excessive movement to cover an intended target. Likewise the force of the resultant streams was at times sufficient to cause injury upon contact with delicate areas such as the eyes. Additionally, most actuator/insert constructions did not permit one to select or modify a spray pattern of a given actuator.

Most of the available overcaps for aerosol products operate to dispense products in the same manner. The overcaps use an actuator to engage an aerosol valve stem to pass the pressurized product into the actuator for dispensing. A portion of the bottom of the overcap is usually attached to the outside diameter of the aerosol valve and container to render it non-removable. The pressurized product is typically dispensed by pressing the actuator into engagement with the aerosol valve stem. Typically, a spring biasing force must be overcome by the actuator in order to engage and depress the valve stem and dispense the product. Since it is desired to allow the user to dispense an aerosol product without necessitating the use of excessive force, the biasing force that must be overcome by pressing the actuator, has generally been relatively minimal. While this condition was necessary for intended operation of the aerosol container, it likewise made the undesired effect of potential unintended actuation and dispensing just as easy. This was a particular problem for any aerosols that contain active ingredients that could cause some degree of harm or discomfort to the user or surroundings. As a result, significant efforts have been directed towards making accidental dispensing of aerosol containers more difficult to occur.

A typical way of attempting to prevent the accidental, or otherwise unintended, dispensing of aerosol products has been to add a locking mechanism to the overcap. Most such mechanisms provide an additional piece on the aerosol overcap that requires the user to move the piece into a disengaged position in order to dispense the aerosol. Many of these devices, however, are either inconveniently located, difficult to operate with one hand or are themselves, readily unintentionally moved into engagement. An example of such a locking mechanism is a sliding lever on the side of the housing. In use, however, such a locking mechanism is often covered by the user's palm or fingers when dispensing the product from the aerosol container. Such locking mechanisms frequently exhibit an additional drawback, in that once the actuator is in an unlocked position, it remains unlocked and makes the system available for unintentional operation. The mechanism does not lock automatically after dispensing, but instead requires the user to perform an additional intentional locking action to return the lever or the like to a position where it prohibits operation of the actuator.

Another type of known locking mechanism utilizes an actuator that rotates into engagement with a supporting portion of the housing to prevent the user from pressing the actuator except in certain pre-designated positions. Like the mechanism described above, however, once the actuator is rotated into engagement, it remains unlocked until the user performs an additional intentional locking action as such accidental dispensing is only partly prohibited and the user again must remember to relock the system to prohibit such circumstances after use. A further problem with these systems and the previously described lever locking mechanisms, is that there is still a significant chance that the device can reach a disengaged or unlocked position due to environmental or unintentional acts, rather than the intentional act of the user thereby freely permitting accidental dispensing of product from the aerosol.

Some locking mechanisms that have utilized a spring-loaded system to return the device to a locked condition after dispensing have also exhibited shortcomings. Such devices have often required two hands for operation. Those devices that permit some type of single-handed operation, usually required the user to see the locking device to operate them, thus rendering them useless, for example, in the case of darkness or engaging a potentially hostile person with a non-lethal incapacitating spray.

Another known type of overcap uses a trigger to actuate the aerosol valve to dispense the aerosol product. The trigger usually is a separate piece or more often a number of pieces that are added into the housing of the overcap. The trigger is generally contained in the housing by undercuts or the like. Because the trigger is added to the actuator system, it can be dislodged from the housing when dropped or struck making operation of the dispensing system impossible. Other known designs have used additional parts in the assembly to lock the trigger when not in use, thereby introducing additional complexity. Such designs have still not provided the combination of a self locking action once the actuator is released into a closed position, along with the advantages of an improved spray pattern and ease of operation with one hand. In addition, many of these mechanisms have had difficulty handling submergence in water, shock and extreme operating temperatures while providing quiet and consistent use.

In view of the above, it is apparent that there exists a need in the art for an improved aerosol spray delivery and dispensing method and apparatus that overcomes the problems and difficulties described. It is the purpose of this invention to fulfill the above described needs in the art, as well as other needs apparent to the skilled artisan from the following detailed description of this invention.

SUMMARY OF THE INVENTION

The spray delivery system of the present invention permits the dispensing of aerosol products in an improved, precise and specific pattern of spray. The spray of this delivery system, likewise selectively provides hybrid type spray patterns in a device and method that contains (i.) A first locking feature that prevents accidental or unintended dispensing of the product during shipment and prior to initial use that can be visually detected and must be removed in order to make use of the device; (ii.) A second locking mechanism that requires the user to depress a locking spring and the actuator in order to dispense product and automatically returns the device to a locking position after dispensing; (iii.) An override system force that the second locking mechanism that provides user with a means to disarm the second locking means for unencumbered use of the system; and (iv.) Offers a precise pre-selected spray pattern emanating from the actuator. These advantages are all provided in an easy to assemble spray delivery system that is compact and can be easily carried in the pocket of a user, can be operated with one hand, does not require user to be able to see the system to operate and has further safeguards to minimize the possibility of any of the material dispensed from the aerosol container through the system of coming into contact with the user.

This invention fulfills the above described needs in the art, and provides these and other advantages in a spray delivery system and method for aerosol containers, the system comprising:

a shell having a first wall with first and second apertures therein, a second wall, and a housing extending outwardly from said shell and surrounding said first aperture;

a lock having a first end with a depressible button and a second end with a spring, said button extending through said second aperture of said shell, said remainder of said lock being within said housing and movable from a first position wherein said button extends through said second aperture and outwardly from said shell an axial distance less than said housing, to a second position wherein said button is depressed and a substantial portion thereof is contained within said shell and said spring is compressed against said second wall of said shell and exerts a biasing force on said lock to automatically return it to said first position when said button is released; and an actuator having a top, a nozzle and at least one projection extending downwardly from said top and slideably engaging a portion of said lock, said nozzle being contained and vertically movable within said housing, said projection further contacting said portion of said lock so that it is thereby prohibited from vertical movement when said lock is in said first position and being capable of vertical movements when said lock is in said second position.

BRIEF DESCRIPTION OF THE DRAWINGS

The present invention has various configurations, constructions in operation will be best further described in the following detailed description, taken in conjunction with the accompanying drawings in which.

Figure 1:
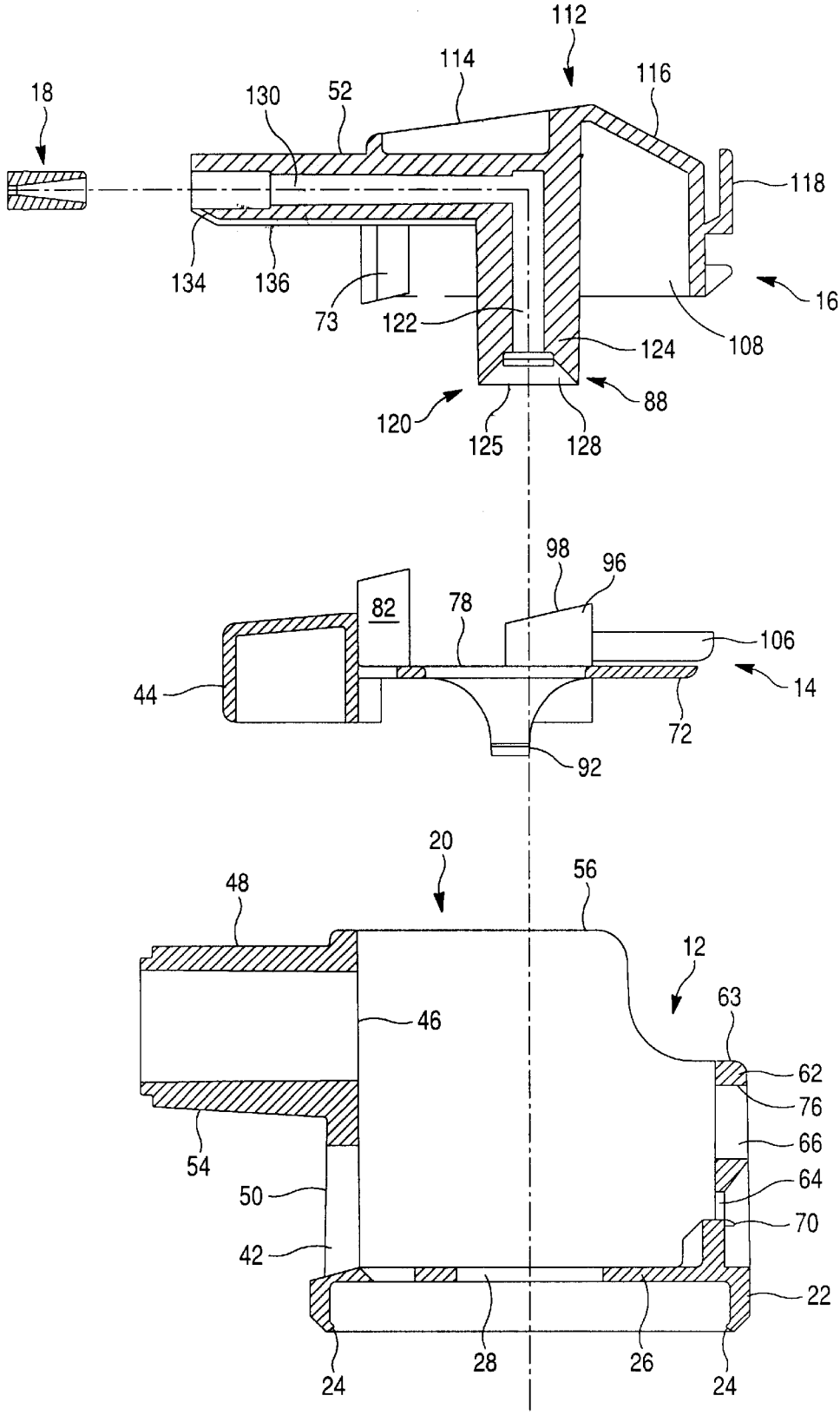
FIG. 1 is an exploded view of the main parts of one embodiment of the present invention.
Figure 2:
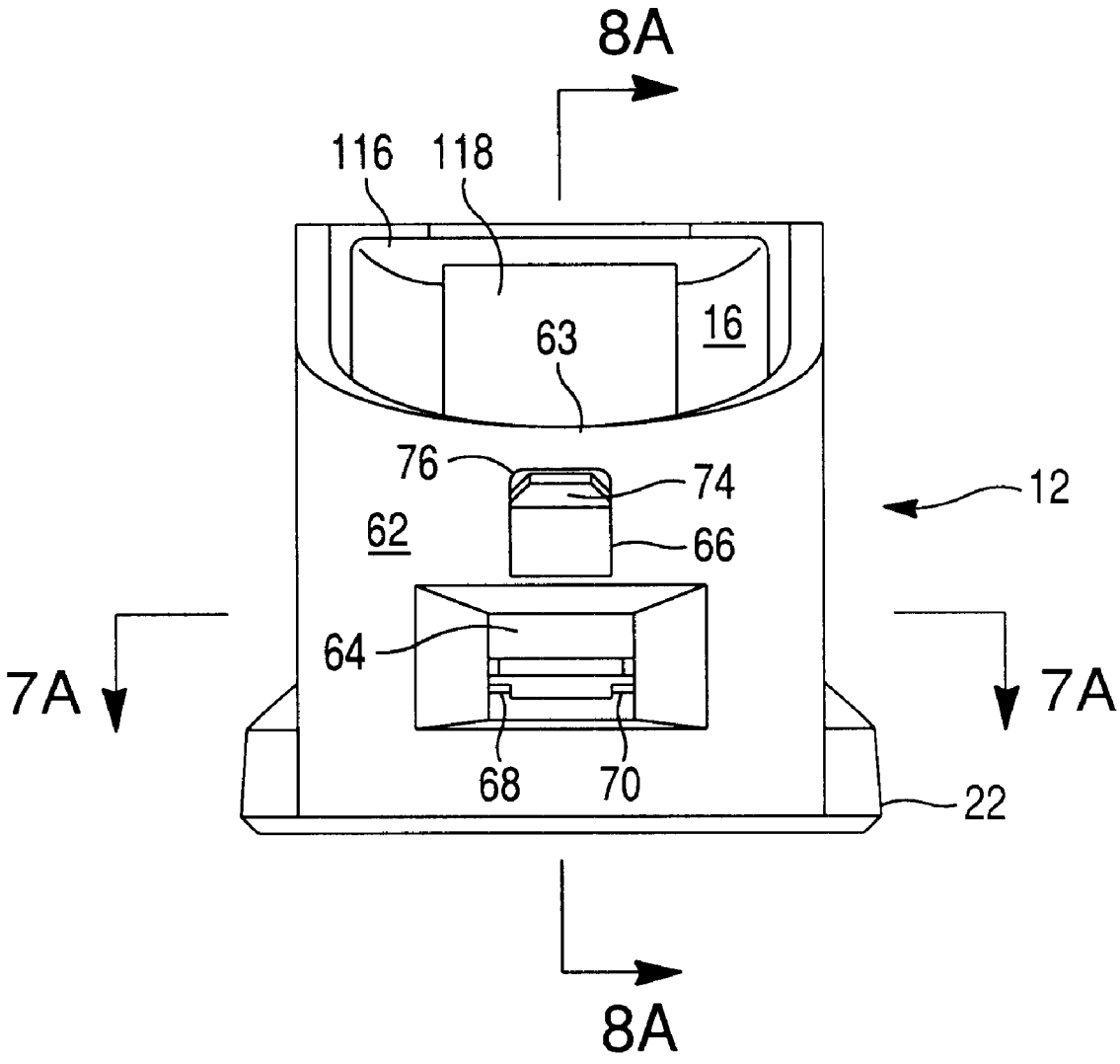
FIG. 2 is a rear plan view of one embodiment of the present invention.
Figure 3:
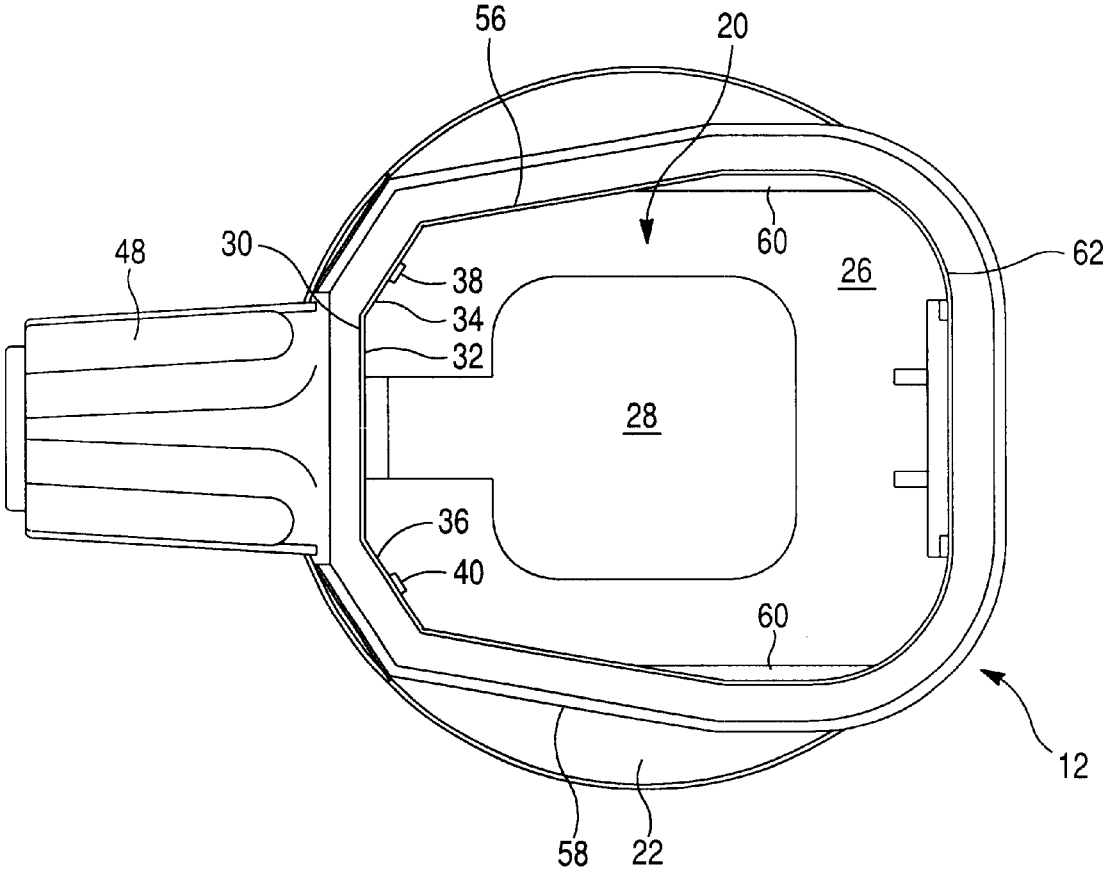
FIG. 3 is a top plan view of an overcap construction of the present invention.
Figure 4:
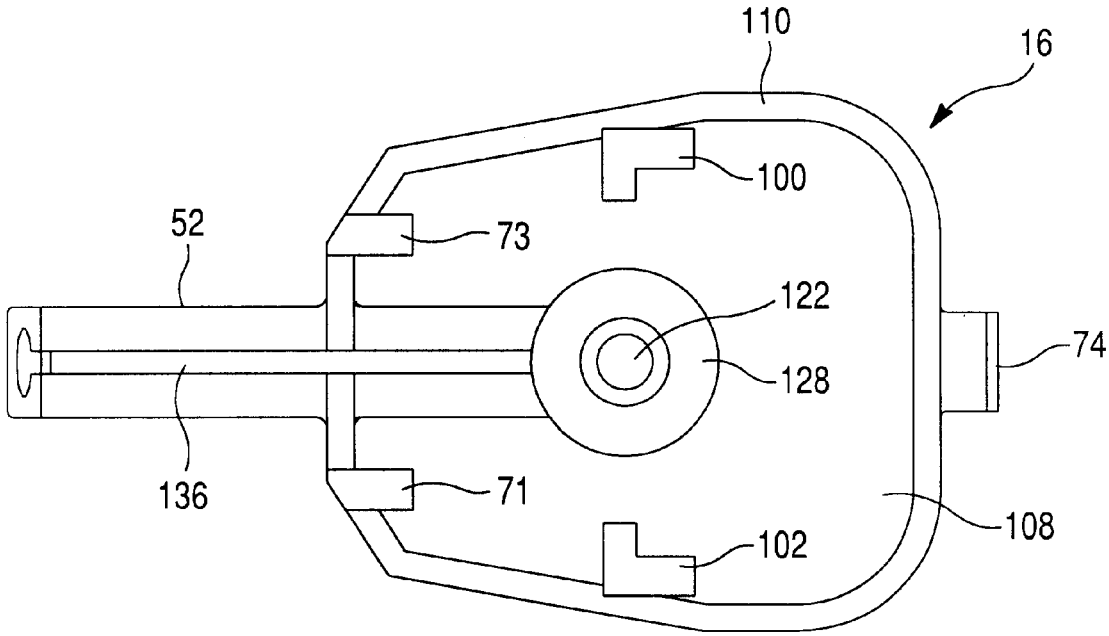
FIG. 4 is a bottom plan view of an actuator construction in accordance with an embodiment of the present invention.
Figure 5A:
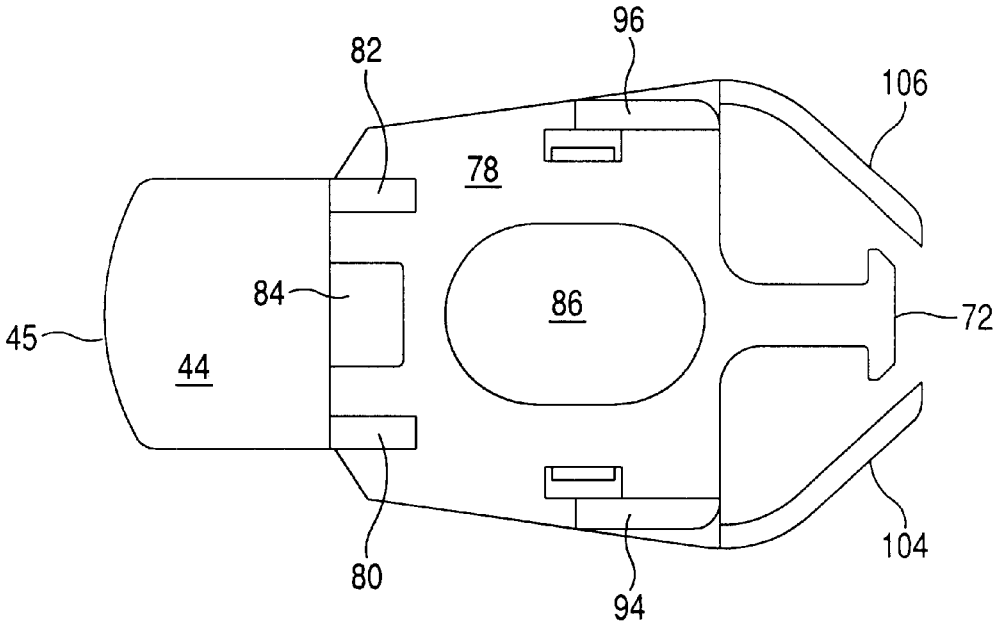
FIG. 5A is a top plan view of a spring lock of one embodiment of the present invention.
Figure 5B:
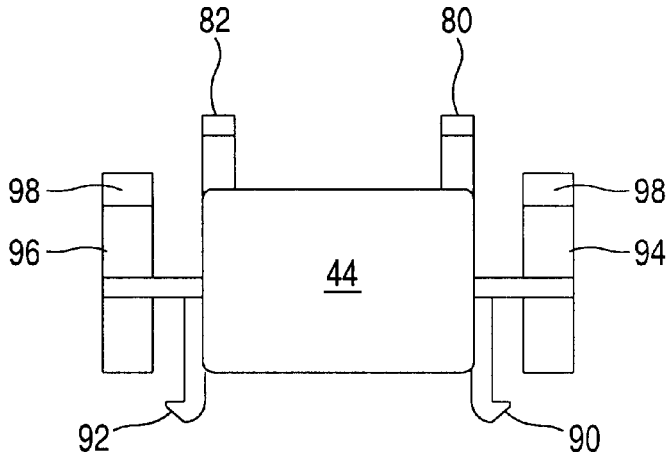
FIG. 5B is a front view of the spring lock mechanism of the present invention illustrated in FIG. 5A.

This invention will now be described with reference to the drawing figures in which like reference numbers indicate like parts throughout the several views. It will be appreciated by those of skill in the art that the spray delivery system and device and method may be used in conjunction with virtually any type of aerosol product or container. However, the present invention is described below in an exemplary non-limiting preferred embodiment, in which it is used in conjunction with a non-lethal incapacitating aerosol, containing oleoresin capsicum. Such materials and novel solvents for use with the present invention are shown for example in the co-pending application, U.S. Ser. No. 10/036,546 entitled "Non-lethal Temporary Incapacitation Formulation and Novel Solvent System" filed concurrently herewith, the disclosure of which is hereby incorporated by reference.

The present invention is shown in the several embodiments of FIGS. 1–10, for use in connection with conventional aerosol containers having depressible valve stems. The conventional aerosol container indicated by the numeral 1, is provided with a top 3 with a centrally located valve stem 5, which is spring biased and which is normally maintained in its elevated or raised position to close the discharge outlet through the valve stem. When the valve stem 5 is depressed, or pushed inwardly relative to the container 1 and parallel to the axis of the container, then the aerosol material in the container is discharged through the valve stem, all of which is conventional.

The spray delivery system and device of the present invention, is referred to generally by the numeral 10. The device 10, is formed of several main components, namely, an overcap generally designated by the numeral 12, a spring lock generally designated by the numeral 14, an actuator generally designated by the numeral 16 and an optional nozzle insert generally indicated by the numeral 18. All of these components are constructed of a durable material designed to handle complete submergence in water, shock, extreme operating temperatures, and resistance to chemicals while providing reliable consistent and quiet movement and performance. A variety of plastic materials have been found to be preferable in achieving this performance. Particularly preferred plastic materials meeting these criteria have been found to be Amoco Polymers ACCUTUF 3541 for the overcap, Amoco Polyproylene 3432 for the actuator and Ticona Celcon M-90 for the insert the spring lock. In order to achieve the desired performance characteristics of the device, it will be appreciated that all of the main components are substantially housed within the overcap 12.

The overcap 12, is provided with a hollow body or shell generally indicated at 20, with the bottom or skirt portion 22 thereof having an annular shape, with an inwardly projecting annular rib 24, that is adapted to seat on the annular rim 7 of the aerosol container to retain the device thereon in known manner. The shell body 20 of the cap 12 has a floor 26 with an aperture 28 therethrough that permits the valve stem 5 to extend into the interior of the shell 20, and further allows the top 3 of the aerosol container 1 to seat properly on the device as illustrated, for example, in FIGS. 8A–D. The device 10 is designed to occupy essentially the same circumferential areas as the aerosol container 1 that is mounted on for ease of operation and storage.

The shell body 20 has a front wall 30 that extends upwardly from the floor 26. The front wall 30 has a central portion 32 and integral angled peripheral portions 34 and 36 respectively. Portions 34 and 36 are angled preferably between 20 to 40 degrees to assist a user in initially locating and thereafter retaining their thumb on the actuator without requiring the user to look at the device. The interior portion of each of the respective angled portions, 34 and 36 respectively, can each be provided with a ridge 38 and 40 respectively. These ridges assist in engaging and maintaining the spring lock 14 in the overcap 12 in proper alignment as will be described to follow in detail. The front wall 30 also has a vertically spaced aperture 42 extending upwardly from the skirt portion 22 to accommodate the button 44 of the spring lock 14. The front wall 30 has an opening 46 located above the aperture 42. The opening 46 leads to a nozzle housing 48 that extends axially from the exterior face 50 of the front wall 30. The nozzle housing 48 accomodates and shrouds the nozzle 52 of the actuator 16 which is permitted vertical movement therein, as will be later described. The housing 48 extends axially beyond the end of the nozzle 52 in order to prevent any damage or harm to the nozzle as a result of impact or the like.

The housing 48 preferably has a flat lower surface 54 and preferably extends for a length greater than the thickness of an average human index finger when the button for 44 of the spring lock 14 is fully depressed. The flat surface 54 and the extended length of the housing 48 assist in both enabling a user to position his finger on the button 44 by touch alone without having to see the device 10. Furthermore, the flat surface 50 combined with a preferred slight angle on that surface, encourage free movement of the user's finger in a sliding relation along the bottom surface 50 of the nozzle housing to operate the button 44.

The shell body 20 has oppositely disposed side walls 56 and 58 respectively that extend upwardly from the floor 26 and are substantially the same height as and are integral with the angled peripheral portions 34 and 36 of the front wall 30. Side walls 56, 58, are preferably angled slightly inwardly from the back of the overcap 12 towards the nozzle housing 48 and are spaced from each other sufficient distance to accommodate the thumb of a user, whether wearing a glove or not, and urge the thumb into the proper position to depress the actuator 16 as will be described to follow. The interior of each of the side walls, 56 and 58 respectively, each contains a guide 60 preferably molded into the interior surface thereof. These guides assist in keeping the spring lock 14 aligned properly within the overcap 12.

The side walls 56, 58 are joined at one end by a rear wall 62. The rear wall 62 extends upwardly from the floor 26 to a height less than the side walls 56 and 58 and front wall 30. With particular reference to FIGS. 1, 2, 3, 7A and 7B, the rear wall 62 contains a locking aperture 64 and a retaining slot 66. The locking aperture 64 contains two projections 68 and 70 respectively. Projections 68, 70 are used to contact and temporarily retain the spring lock hook 72 of spring lock 14 when it is desired to maintain the device 10 in an always armed or override condition where the button 44 of the spring lock 14 need not be depressed prior to dispensing material from the aerosol container 1. As particularly illustrated in FIGS. 1, 2 and 3, the aperture 64 and projection 68 and 70 respectively, are preferably recessed within the rear wall 62 so that the hook 72 is unlikely to be accidentally engaged or disengaged from the projections 68 and 70 through inadvertent contact. The retaining slot 66 surrounds the outwardly protruding lug 74 of the actuator 16 and permits a limited degree of vertical movement of the lug when the actuator is depressed. The top portion 76 of the aperture 64 serves to assist in retaining the actuator within the overcap 12 by prohibiting the actuator to be raised any further vertically than the point at which the lug 74 contacts the top portion 76. The lug 74 serves to limit downward travel of the actuator 16 in a similar manner.

Referring now to FIGS. 1, 2, 5A, 5B, 7A, 7B, 8A–D and 9A–9B the spring lock 14 of the present invention is illustrated. Spring lock 14 has a main body 78 with a depressible button 44 located at one end. When the spring lock 14 is assembled in the overcap 12 the button 44 extends through the aperture 42 in the front wall 30 of the overcap 12. The end 45 of the button 44 is preferably contoured to readily accommodate a user's index finger. The main body 78 also has upwardly extending posts 80 and 82 that are integral with the button 44 and are contained within and contact the angled peripheral portions 34 and 36 respectively of the front wall 30 of the overcap 12. In this manner posts 80, 82 serve to limit the axial distance that the button 44 can project outside of the overcap 12 and further serve along with the ridges 38, 40 of the overcap 12 to maintain the spring lock in proper alignment within the overcap. The body 78 of the lock 14 further features a forward aperture 84 and a central valve stem aperture 86. The valve stem aperture 86 allows the valve stem 5 of the container and the lower portion 88 of the actuator 16 to pass therethrough without restricting the vertical movement thereof. The forward aperture 84 permits any excess material that has been dispensed from the nozzle 52 that falls within the nozzle housing 48 or travels along the notch 136 to drop therethrough and be deposited through the aperture 28 onto the top 3 of the container 1. This construction prevents the user from contacting any such material.

The spring lock 14 is retained vertically in position within the overcap 12 by downwardly extending hooks 90 and 92 respectively. Hooks 90, 92 bear against the bottom of the floor 26 at opposing edges of the aperture 28 and bias the spring lock 14 against the top surface of the floor 26 and permit axial movement of the spring lock along a portion of the aperture 28. The hooks 90 and 92 slideably contact the floor 26 when the spring lock 14 is properly assembled in the overcap. The spring lock 14 also has vertical ribs 94 and 96 respectively. The top portion 98 of each of the ribs 94, 96 is preferably angled from the back to the front of the spring and has a flat surface.

As particularly illustrated in FIGS. 8A–D and 9A and 9B the top portion 98 of the ribs 94, 96 serves to contact the projections 100 and 102 respectively of the actuator to support and prevent vertical movement of the actuator when the device 10 and the spring lock 14 is in a rest or unactuated position. As particularly illustrated in FIGS. 9A and 9B, ribs 94, 96 thereby prevent accidental or unintended actuation of the device 10 by prohibiting downward movement of the actuator 16. The button 44 of the lock 14 must be angled sufficiently depressed to allow the projections 100 and 102 to engage a lower part of the angled top 98 of the ribs and/or clear the ribs entirely to allow sufficient downward movement of the actuator to depress the valve stem 5 and dispense material from the container 1. The angled top 98 of the ribs 94 and 96 serves to encourage free travel of the projections 100 and 102 thereon as the button 44 is depressed and also permits and encourages proper seating of the actuator 16 thereon. It has been found that a variety of different angles are acceptable for the top 98 of the ribs 94 and 96 but that an angle of 10 to 20 degrees, and most particularly about 13 degrees, has been shown to have particularly desirable results in operation.

Extending from the rear of the main body 78 of the spring lock 14 are opposed leaf springs 104 and 106 respectively and a spring lock hook 72 when the spring lock 14 is appropriately assembled within the overcap 12 the leaf springs 104 and 106 respectively contact the rear wall 62 of the overcap 12 between the locking aperture 64 and the retaining hole 66. In a rest position when no force is applied to the button 44 the leaf springs 104 and 106 serve to bias the button into a fully extended position whereby the posts 80 and 82 of the spring lock 14 are in contact with the interior surface 31 of the front wall 30 of the overcap 12 and the spring lock hook is contained within the shell body 20. The posts 80 and 82 each have angled top surfaces that contact the bottom of the supports 71 and 73 respectively of the actuator 16 when the button 44 is not depressed. In this position the posts 80 and 82 contact and prevent the actuator 16 from being depressed. When the button 44 is sufficiently depressed, the posts 80 and 82 move out of contact with the supports 71, 73 thereby permitting downward motion of the actuator to dispense aerosol material. The angle of the top posts 80, 82 is preferably the same as the top 98 of the ribs 94, 96.

As particularly illustrated in FIGS. 2, 7B and 8B–D when the user desires to dispense material from the container one must exert a sufficient axial force against the button 44 to overcome the biasing force of the springs 104 and 106. In this condition, the spring lock hook 72 extends outside of the rear wall 62 axially beyond the projections 68 and 70. Once pressure sufficient to overcome the bias of the springs 104 and 106 is released from the button, the springs 104 and 106 automatically bias the spring lock 14 back into its rest position where the device is protected from unintentional operation.

The spring lock 14 can be selectively maintained in a constantly armed condition that does not require depressing of the button 44. In order to use the actuator 16 to dispense material from the container 1 in this condition, when the button 44 is depressed, the spring lock hook 72 is manually bent downwardly so that it is engaged in the projections 68 and 70. In this condition, the device 10 is armed and the actuator 16 can be freely operated without requiring the user to do anything with the button 44. The spring lock hook 72 has a built in biasing force that tends to urge the hook into a parallel alignment with the main body 78. In the override or armed position, the hook 72 is bent downwardly. When it is desired to remove the device from this armed or override condition and back to one where the button 44 must be depressed in order to use the actuator 16, the user need only depress the button 44 a sufficient axial distance so that the spring lock hook 72 clears the projections 68 and 70. The lock hook 72 will automatically return to its safety or rest position wherein the lock hook 72 is substantially parallel to the main body 78, thereafter, once the user stops exerting sufficient force against the button 44, the spring lock 14, will be returned to its auto-lock position where the button 44 must be depressed to enable the actuator 16 to dispense material from the device.

The next main component of the device 10 is the actuator 16. The actuator 16 has a substantially hollow body 108 having a continuous outer wall 110 that closely follows the shape and dimension of the overcap 12 into which it is assembled. The outer wall 110 contains a void in the area under the nozzle 52. The outer wall 110 is integral with and connected to a top 112. The top features an actuating pad 114 and a finger rest 116. The pad 114 and the rest 116 are preferably provided with a rough surface to assist the user in gripping the device whether with a hand or a glove without slipping. As particularly illustrated in FIGS. 1, 2 and 8A–D, the actuating pad 114 is preferably angled downwardly toward the front of the top 112 so that the actuator 16 has a vertical height within the overcap 12 approximately equal to the height of the sidewalls 56 and 58 at its highest point, the pad 114 extends downwardly toward the front of the top 112 such that a sufficient portion of the front wall 30 and angled peripheral portions 34 and 36 extend above the pad 114 to serve as a guide and stop for the finger of the user. This ensures proper positioning of the user's finger to depress the actuator without necessitating the user seeing the device to achieve this condition and also forms a ridge to help maintain the user's finger both axially and laterally within this position on the actuator.

Although it has been found that a variety of different angles are sufficient to achieve this desirable effect, angles of about 5 to 15 degrees and most preferably around 8 degrees, have been found to be particularly useful in achieving this purpose. The finger rest 116 is likewise angled but in an opposite direction to the pad 114. This again is done to ergonomically accommodate the bend of a users thumb on the actuator and thereby ease actuation and holding of the device. It has been found that a variety of angles have been useful for the rest 116 to achieve this condition with those range of 25 to 30 degrees being most preferable.

The outer wall 110 of the actuator 16 is provided with a temper evident tab 118 protruding therefrom. This tab 118 prevents operation of the actuator 16 by restricting any downward movement of the actuator 16 by engaging and overlapping the top edge 63 of the rear wall 62 making it impossible to actuate the device 10 until the tab 118 is removed. The tab 118 provides another safety device for transit and shipment of the device 10 before it is used. It also provides a readily visible indication that the device 10 has not been previously used. In order to use the device 10 the user must first remove the tab 118 from the actuator 16 by twisting it off and discarding it. Actuator 16 has projections 100 and 102 respectively, and supports 71 and 73 respectively, that extend downwardly from the top 112 that are integral with the interior surface of the outer wall 110. As previously described, the projections 100, 102 support the actuator 16 and can travel along the ribs 94, 96 of the spring lock 14. As also previously described supports 71 and 73 support the actuator 16 and travel along the posts 80, 82 as the button 44 is depressed. A protruding lug 74 is located on the rear portion of the outer wall 110. The lug 74 is journaled for vertical movement within the retaining slot 66. The slot 66 restricts vertical movement to the range permitted by the lug 74 contacting either the top or bottom edge of the aperture 64 and further serves to maintain the actuator 16 in proper alignment.

The actuator 16 is further provided with a valve stem actuator 120. The stem actuator 120 has a central chamber 122 located within a chamber wall 124. The bottom of wall 124 terminates in a closed umbrella shaped guide 125 having an angled bottom surface 128. The angled surface 128 tends to assist in urging and retaining proper alignment between the central chamber 122 and the valve stem 5. Angles of about 45 degrees have been found to be particularly useful for the surface 128. The upper end of the chamber wall 124 is integral with a nozzle wall 130 of the nozzle 52. In similar fashion the central chamber 122 is in fluid communication with the nozzle chamber 132. As such when the valve stem 5 is actuated by the actuator 16, pressurized material from the container is dispensed first through the central chamber 122 and then into and out of the nozzle chamber 132 and towards an intended target.

It has been found that the length of the chamber 132 is important in achieving a desired spray pattern. To begin with, the nozzle chamber 132 must be of a sufficient length to allow the material to be dispensed in a uniform manner that is relatively unaffected by wind, rain or like environmental conditions. In this regard, a range of lengths of more than ¼ inch to about 1 ½ inches have been found to be sufficient for this intended purpose with the most preferred lengths being about one inch for the non lethal temporary incapacitation formulation and solvent system of the present invention.

Nozzle 52 can optionally be provided with additional features that can be particularly useful when the device 10 intended is used in connection with potentially harmful or irritating aerosol materials. A notch 136 can be provided in the bottom of the portion of the nozzle wall 130 that extends outwardly beyond the wall 110. Alternatively the notch 136 can extend along the entire length of the nozzle 52. As illustrated in FIGS. 8A–D and as previously described, in use the nozzle 52 will move vertically within the nozzle housing 48. When the actuator 16 is released it is possible that a small amount of material from the aerosol container may remain at the end of the nozzle 52 after use. If this occurs then the notch 136 facilitates the channeling of any such material along the nozzle 52 to direct the material away from the finger of the user to the interior of the overcap 12 and into the top 3 of the container 1. The bottom of the nozzle housing 48 may optionally also be slightly inclined toward the shell body 20 of the overcap 12 to assist this result. An angled surface 134 can further be provided at the end of the nozzle to both facilitate this action and to permit the actuator to be more easily inserted and assembled into the overcap 12 and nozzle housing 48.

It has also been found that achieving a hybrid spray pattern (e.g. combination of cone and stream pattern) is facilitated by tapering the nozzle chamber 132 slightly from a larger opening at its exit end to a slightly smaller diameter opening where it contacts the central chamber 122 of the stem actuator 120. Although a variety of tapers have been found to be sufficient, one of approximately one half degree per side has been found to produce particularly beneficial results.

As previously described, there is a great difference between the prior art stream and cone spray patterns when compared to the hybrid spray patterns achievable using the present invention. The stream pattern requires precise aiming and multiple actuations to cover the entire surface of the desired target. If a target is moving erratically, (e.g. during an arrest of an unruly subject by a police officer using a non-lethal incapacitating spray) there is a strong chance that the target will be missed by a narrow stream pattern, due to the difficulty in aiming at a small facial target. Additionally, if the spray pattern is too focused, it can also cause damage to the eyes of a target at close ranges due to its sharp and needle like pattern.

Figure 6:
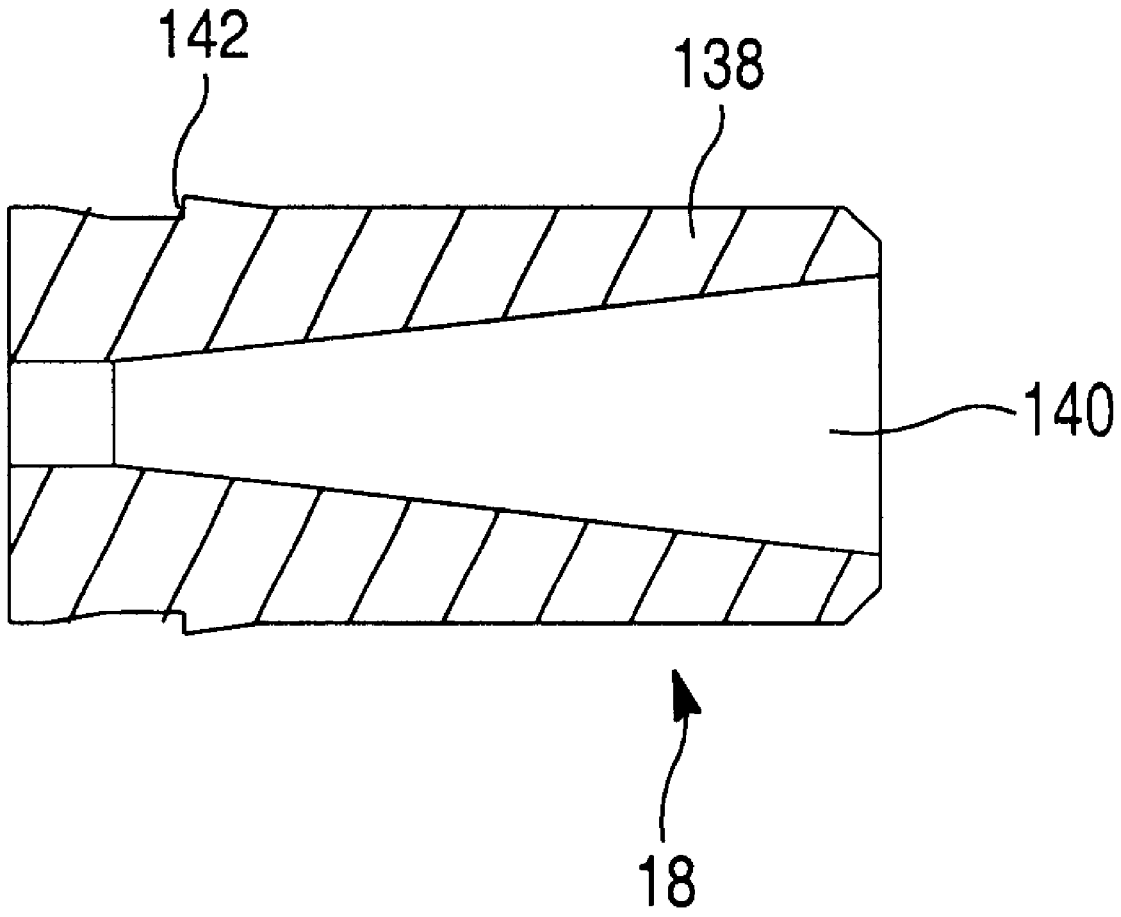
FIG. 6 is a cross-sectional view of one embodiment of a spray nozzle insert, taken along section 6—6 of FIG. 1

One of the advantages of the device 10 is the versatility and precision of its spray pattern. Such spray patterns can even more readily be achieved by utilizing a nozzle insert 18 in the nozzle chamber 132 of the actuator 16. As illustrated in FIGS. 1 and 6, the insert 18 has a wall 138 and central orifice 140 extending along its entire length. It has been found that various inserts of different dimensions can be placed in the nozzle 52 permanently by molding or similar techniques to produce different desired spray patterns. The insert 18 may contain an optional projection 142 in the wall 138 to assist in retaining it within the nozzle chamber 132. It was found, for example, that a nozzle insert 18 that was large at the beginning of the orifice and narrowed like a funnel at the orifice exit was particularly advantageous for the application of pepper spray. This insert 18 results in a spray pattern can also be used in any household or industrial application where a precise and focused pattern, unaffected by wind as desired, such as spraying an entire target such as a beehive or a wasp's nest. Choice of a particular insert design will also depend upon the formulation, propellant, solvent and pressure of the aerosol material and the desired characteristics of the spray pattern.

Extensive experimentation was conducted with the present invention to achieve advantageous hybrid spray patterns and design the particular geometries of nozzle inserts to be used in the present invention. These results and findings of this experimentation are summarized in the following example. While this example will show one skilled in the art how to operate within the scope of this invention, it is not to serve as a limitation on the scope of the invention.

EXAMPLE 1

Various tests and nozzle inserts were developed and tested to meet the following criteria when used in the present invention.

Spray pattern must be stable in wind. Typical spray patterns that atomize such as fog or cone are not stable and subject to wind movement.

At impact with the target, spray pattern must cover the entire target with one shot. Spray patterns that are solid stream in nature require multiple shots in order to cover the entire target.

Spray must penetrate windy conditions. Typical spray patterns that atomize, such as fog or cone, are not narrow and sharp enough to penetrate into wind and reach the target and will immediately atomize.

Eliminating blow back on the user. Typical spray patterns that atomize, such as fog or cone, can be blown back on user in windy conditions.

In order to eliminate effects on bystanders, or missing the target, the spray must not be affected by cross wind. Typical spray patterns that atomize such as fog or cone are subject to wind movement during cross winds.

The spray must not aerosolize and mist, and can be used indoor and in confined areas. Typical spray patterns, such as fog or cone, atomize indoor and may travel to areas other than the target, including circulation in HVAC.

Must reach the target even during rain. Fog or cone patterns are not narrow and sharp enough to penetrate wind and reach the target.

The goal was to develop nozzle inserts and resilient hybrid patterns that achieved the benefits of both solid stream and cone spray pattern. A plexiglass sheet of 5 feet by 5 feet square and ¾ of an inch thick was placed vertically as a target. Digital video cameras were placed behind the glass and at a 90 degree angle to the glass. Water was used as the liquid projectile due to its molecular weight of 18.02 mw and evaporation rate 18.96 mmHg. Tests were performed at approximately 70° F. with a constant pressure of 40 PSI. Various nozzle insert orifices in accordance with the present invention, were designed in different dimensions made of polypropylene plastic as follows (dimensions are in inches):

| Beginning of Orifice | Orifice Exit | Orifice Shape |
|---|---|---|
| 0.100 | 0.030 | Circle |
| 0.090 | 0.030 | Cylinder inserted in orifice tube |
| 0.090 | 0.030 | Circle |
| 0.090 | 0.040 | Circle |
| 0.085 | 0.040 | Circle |
| 0.085 | 0.030 | Circle |
| 00.80 | 0.040 | Circle |
| 0.080 | 0.030 | Circle |
| 0.080 | 0.010 | 4 hole shower design |
| 0.070 | 0.040 | Circle |
| 0.070 | 0.030 | Circle |
| 0.070 | 0.070 | Rectangle |
| 0.060 | 0.020 | Oval |
| 0.060 | 0.010 | Oval |
| 0.060 | 0.020 | Circle |
| 0.040 | 0.080 | Circle |
| 0.030 | 0.030 | Circle |
| 0.020 | 0.080 | Triangle |
| 0.020 | 0.060 | Oval |
| 0.020 | 0.080 | Circle |
| 0.010 | 0.040 | Circle |

Water was continuously flowed through the selected orifices and videoed. The resultant impact pattern was measured and noted. The pattern and trajectory of water in flight was then evaluated and analyzed using the following procedure.

An industrial and customized fan approximately two feet in diameter was used to generate various wind speeds. A wind meter was used to log the speed. The fan was placed in three different pre-selected positions. In position (a) the fan was directly facing the spray and spraying into the wind. In position (b) the fan was directly behind the spray to assess tail wind. In position (c) the fan was at a 90 degree angle or cross wind to the spray to assess side wind. The fan generated speeds of 5, 10, 15, 20, 30, 40 and 45 miles per hour for each of the three positions.

In all test combinations up to 40 miles per hour, the liquid reached the target successfully. However, above 40 miles per hour in positions (a) and (c) 80% of spray reached the target and the remaining 20% was forced by wind to follow its route thus showing that the liquid is highly stable in windy conditions with no effect on bystanders. Similar tests were conducted using the non-lethal temporary incapacitation formulation and novel solvent system of the present invention and achieved like results. A comparison test was conducted using an isopropyl alcohol solvent where the spray was adversely impacted for all positions at fan speeds below 5 miles per hour. It was determined that spray patterns that met the criteria set forth above had the following elements in common:

1. The beginning of the orifice of the nozzle insert must be larger than the exit orifice, the entire nozzle insert was therefore at the beginning of the orifice and narrowed like a funnel at the orifice exit. This must be in a ratio of between about 2 to 1 to 5:1.
2. The nozzle insert orifice must be a perfect circle shape throughout the entire orifice funnel, beginning, middle and end.

It was found that as the water entered into the large opening of the nozzle insert orifice funnel, it traveled toward the smaller exit orifice. As the water exited, it took the shape of the small circular orifice and in a solid stream fashion travels toward the target. At impact with the target, the stream opened up, taking the circular shape of the funnel at the beginning of its path. The result was a spray pattern that was a solid stream in its trajectory that opened up upon impact providing a hybrid pattern between stream and cone. The range of the stream depends primarily on the pressure and length of the nozzle. The impact pattern dimension depends on the ratio of the orifice. The larger the ratio the smaller the target coverage and vice versa.

Figure 10:
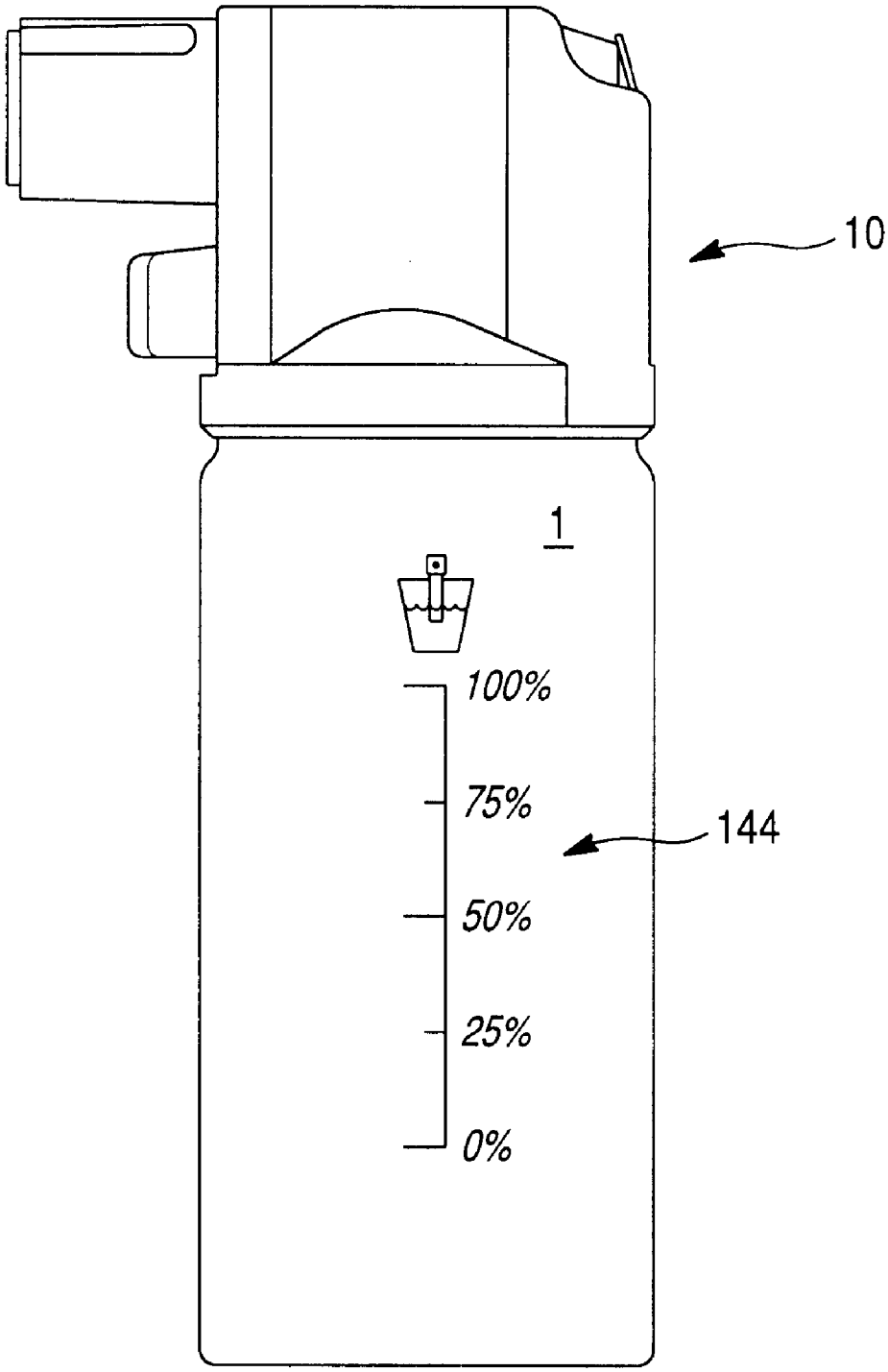
FIG. 10 is a side plan view of one embodiment of the present invention having a content level indicator.

In certain preferred embodiments, the device 10 of the present invention can be combined with a canister 1 having a content level indicator, generally indicated as 144 in FIG. 10. In prior aerosol canisters, it has not been possible to quickly detect the approximate amount of content left therein by the user. A graphical content level indicator 144 is placed on the outside of the container 1 in order to quickly determine the level of formulation in the canister. The location of the level indicator 144 on the canister 1 is determined as follows. First, empty canisters are placed in water to determine the location of the zero percent mark and additional full canisters are placed in water to determine the location of the one hundred percent mark. With these two marks, the locator marks for the twenty five, fifty and seventy five percent levels are located appropriately between the determined zero percent and one hundred percent locator marks. In order to test the content level of an aerosol canister, having a content level indicator, the following procedure is used.

1. Fill a container or drinking cup having a diameter sufficiently large so that the outer surface of the aerosol canister does not come into contact with the container when it is in an upright condition.

2. Place the canister inside the container bottom down.
3. Gently and loosely hold and steady the unit upright inside the water. Care should be taken not to push the canister into the water, but instead to let it naturally float.
4. Observe the water line in comparison with the level indicator printed on the side of the canister to determine the level of contents.

The above described method has been found reliable to quickly detect the approximate amount of content left in an aerosol canister.

Operation

The operation of one embodiment of a completely assembled device 10 of the present invention will now be described with particular reference to 7A, 7B, 8A–D, 9A and 9B. The device 10 is first illustrated in FIG. 8A in a configuration prior to any use thereof in a condition sufficient for shipping or the like. As can be seen in this condition, downward travel of the actuator 16 is further prevented by the vertical ribs 94, 96 and posts 80, 82 of the spring lock 14. Any downward travel of the actuator 16 is further prevented by engagement of the tamper evident tab 118 with the top edge 63 of the rear wall 62 of the overcap 12. In this condition, even if the button 44 of the spring lock 14 is fully depressed, the actuator still will not dispense any aerosol material from the container 1.

Figure 8B:
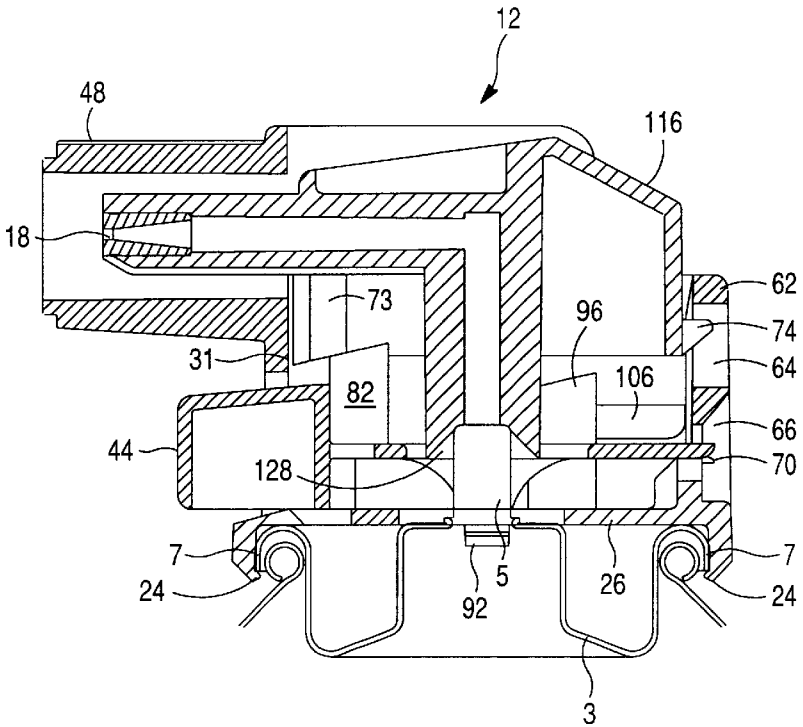
FIG. 8B is a cross-sectional view of an embodiment of the invention taken along section 8—8 of FIG. 2 with the actuator partially depressed.
Figure 8A:
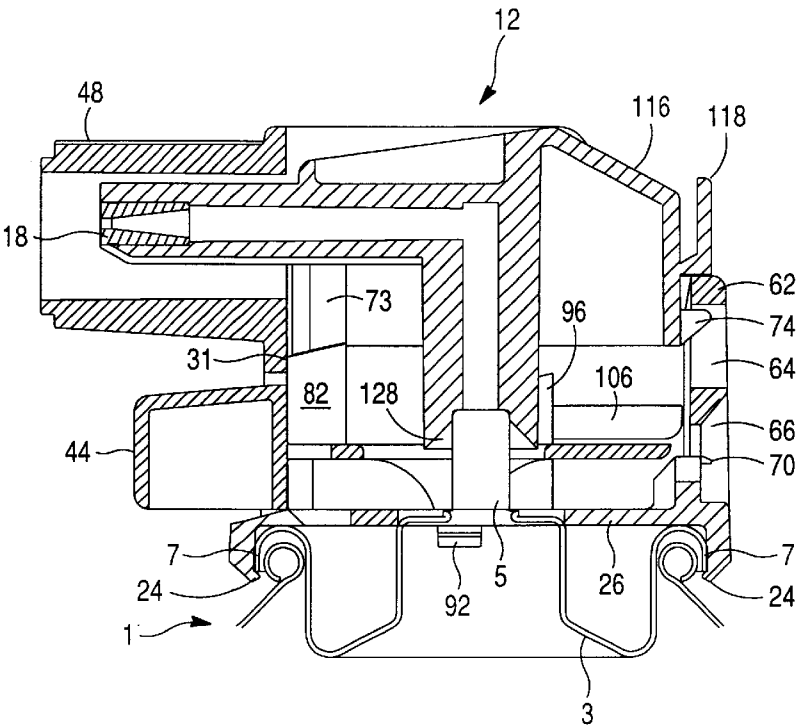
FIG. 8A is a cross-sectional of one embodiment of the embodiment of the spray delivery system illustrated in FIG. 2 in a condition prior to any use of the device.
Figure 8D:
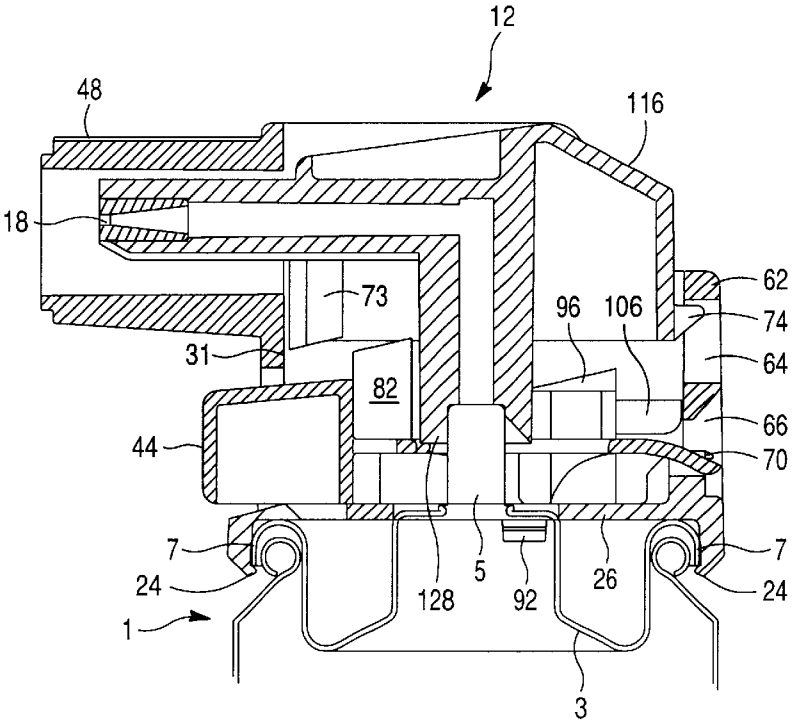
FIG. 8D is a cross-sectional view of an embodiment of the invention taken along section 8—8 of FIG. 2 with the spring lock in a disable mode.
Figure 8C:
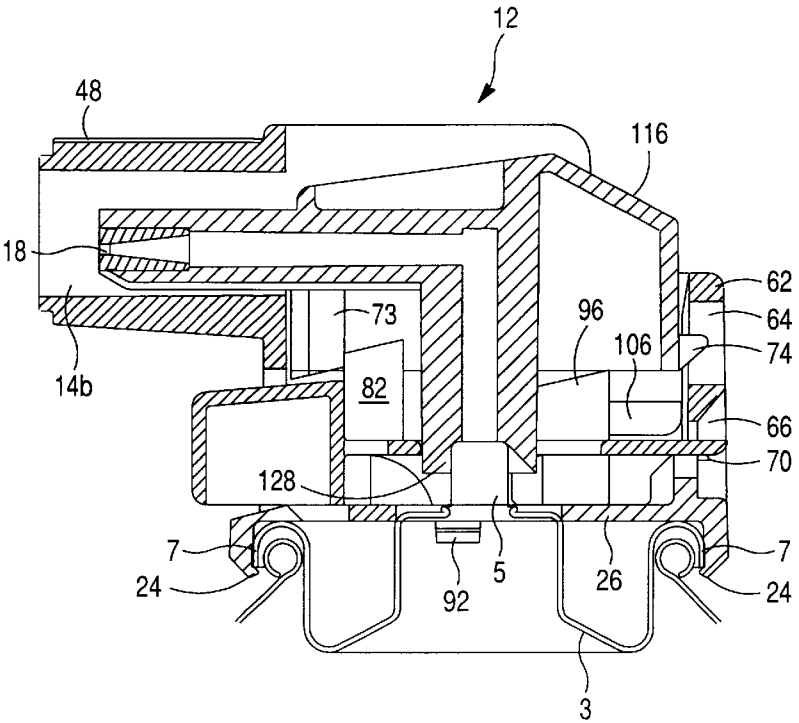
FIG. 8C is a cross-sectional view of an embodiment of the invention taken along section 8—8 of FIG. 2 with the actuator fully depressed.
Figure 9A:
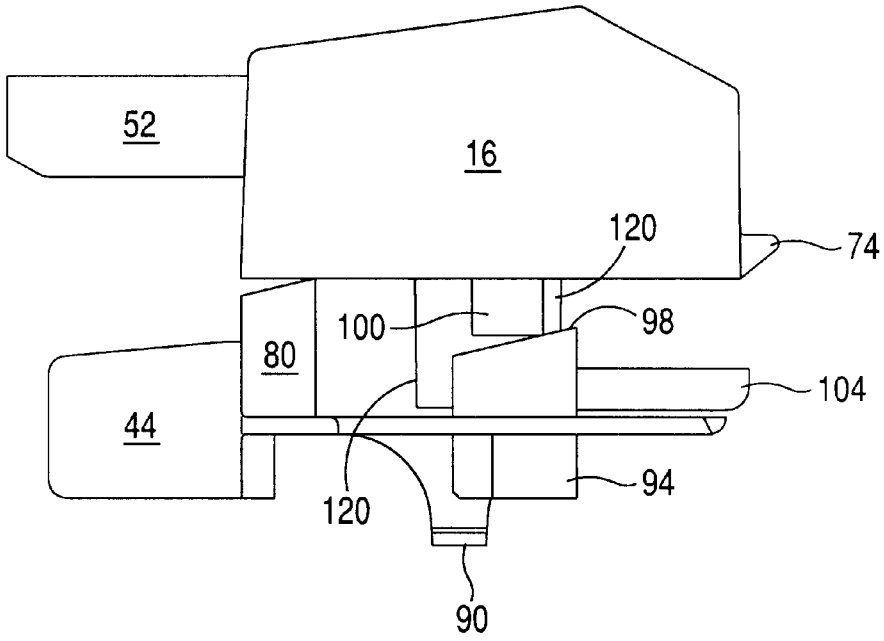
FIG. 9A is a side view of one embodiment of an actuator and a spring lock of the present invention in a locked or up position.
Figure 9B:
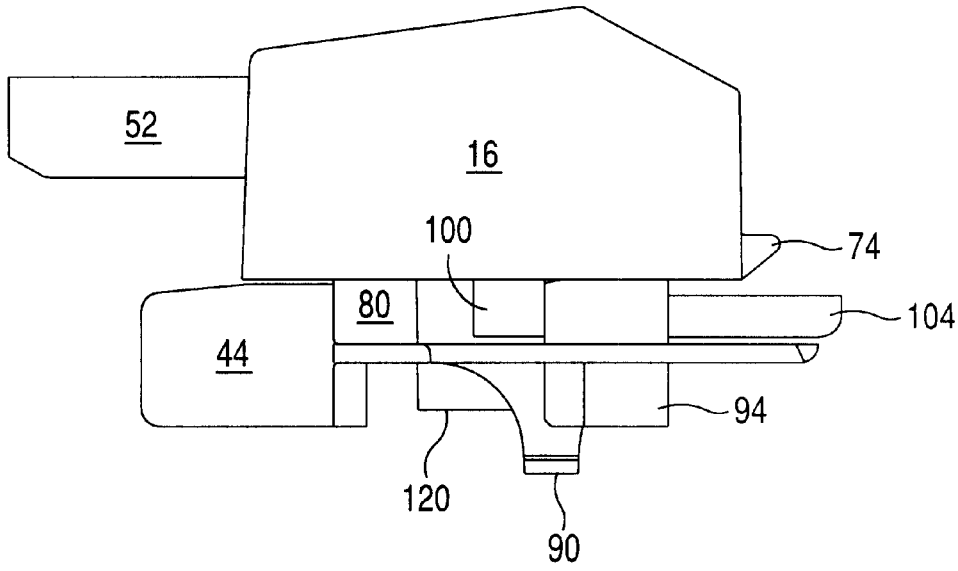
FIG. 9B is a side view of the actuator and spring lock illustrated in FIG. 9A in an enabled or down position.

With reference to FIGS. 8B, 8C, and 9B, the device 10 is next illustrated in a condition wherein the actuator 16 is depressed and material from the container 1 can be dispensed. It will be noted that in order to achieve this condition, the tamper evident tab 118 has been removed from the actuator 16. Thereafter, in order to permit the actuator 16 to be depressed the user must depress the button 44 of the spring lock 14 inwardly. As the user does this, the projections 100 and 102 of the actuator 16, travel down the angled top portions 98 of the respective vertical ribs 94 and 96. At the same time the supports 71 and 73 of the actuator 16 travel down the angled top portions of the posts 80 and 82. The further the button 44 is depressed, the more actuator 16 can be depressed given the angle of the vertical ribs 94, 96 and the posts 80, 82 to a point where the ribs 94, 96 completely clear the bottom of the projections 100 and 102 and the posts 80, 82 clear the bottom of the supports 71, 73 and do not restrict the downward travel of the actuator 16. In this condition the material is dispensed from the container 1 through the actuator 16 and exited out of the actuator nozzle 52 and nozzle housing 48. Similarly, in this condition depressing the actuator 16 has resulted in a change of position of the nozzle 52 to a position where the nozzle wall 130 is adjacent the bottom interior surface 146 of the nozzle housing 48.

Once the user releases downward pressure on the actuator, the spring bias of the valve stem 5 will tend to raise the actuator 16 back to its original unactuated position. Additionally, once the user releases pressure on the button 44, the spring lock 14 is automatically returned to its locked position due to the spring biasing force of the leaf springs 104 and 106. No effort or act of the user is required to automatically return the device to this position. Once returned to the automatic locked position, the spring lock 14, as described above, will prohibit downward travel of the actuator 16, until and unless the button 44 of the spring lock is again depressed.

Figure 7A:
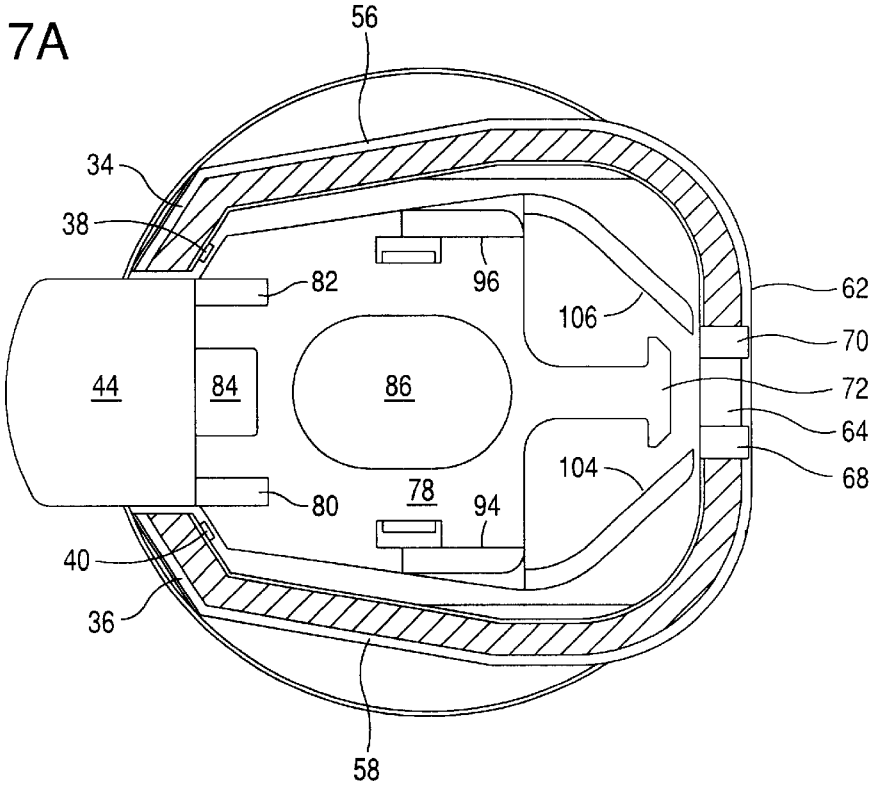
FIG. 7A is a top view of one embodiment of the spring lock of the present invention inserted into an overcap in an unactuated condition.
Figure 7B:
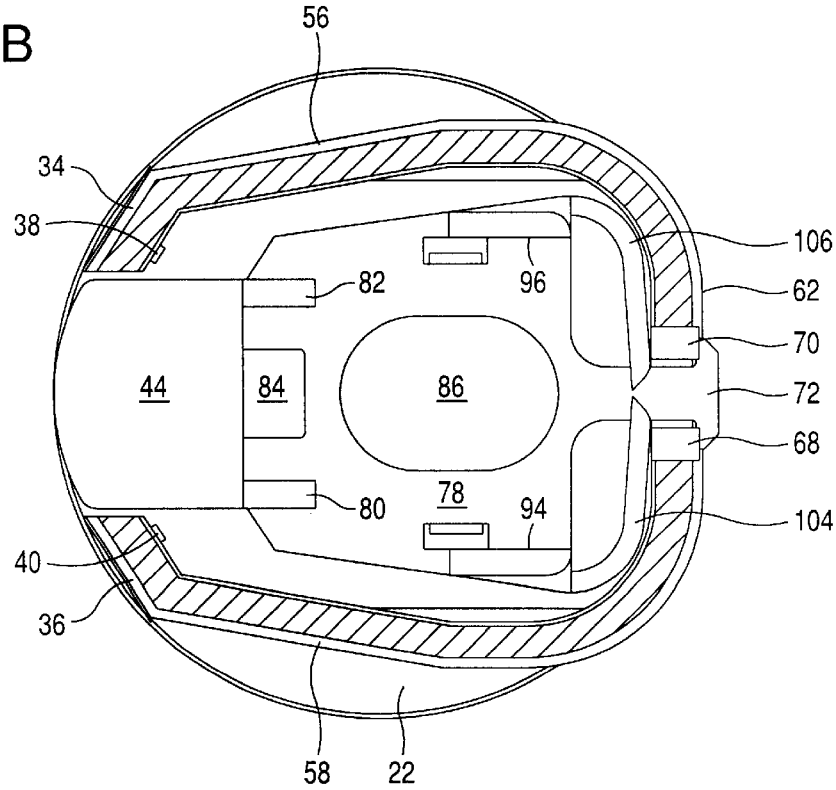
FIG. 7B is a top view of one embodiment of the embodiment of the spring lock illustrated in FIG. 7A in an actuated position.

In the alternative, as illustrated, for example in FIGS. 7B and 8D, once the button 44 of the spring lock 14 is depressed in order to allow the actuator to travel downward sufficiently to dispense product from the valve stem, the spring lock can be maintained in an override or constantly armed position. This is accomplished by bending the spring lock hook 72 downwardly until it is engaged by the projection 68 and 70 of the lock hook 72. In this condition the actuator 16 can be freely depressed to dispense material from the container 1 without having to first depress the button 44. In order to disengage this override or armed condition, the user need only further press the button 44 a slight axial distance sufficient to allow the lock hook 72 to extend beyond the projection 68 and 70. At that point the biasing force of the hook 72 will return it to a position where it is parallel to the main body 78 of the spring lock 14 and the leaf springs 104 and 106 will urge the spring lock 14 into an automatically locked condition.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

We claim:

1. A spray delivery system for aerosol products, comprising:

a shell having a first wall with first and second apertures therein, a second wall and a housing extending outwardly from said shell and surrounding said first aperture;

a lock having a first end with a depressible button and a second end with a spring, said button extending through said second aperture of said shell, said spring being within said housing and movable from a first position wherein said button extends through said second aperture and outwardly from said shell an axial distance less than said housing, to a second position wherein said button is depressed and a substantial portion thereof is contained within said shell and said spring is compressed against said second wall of said shell and exerts a biasing force on said lock to automatically return it to said first position when said button is released; and an actuator having a top, a nozzle and at least one projection extending downwardly from said top and slideably engaging a portion of said lock, said nozzle being contained and vertically movable within said housing, said projection further contacting said position of said lock so that it is thereby prohibited from vertical movement when said lock is in said first position and being capable of vertical movement when said lock is in said second position.

* * * * *